US010851596B2

(12) United States Patent
Roth et al.

(10) Patent No.: US 10,851,596 B2
(45) Date of Patent: Dec. 1, 2020

(54) MULTI-LEVEL WELLHEAD SUPPORT PLATFORM

(71) Applicant: Saudi Arabian Oil Company, Dhahran (SA)

(72) Inventors: Brian A. Roth, Dhahran (SA); Jinjiang Xiao, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 84 days.

(21) Appl. No.: 15/827,247

(22) Filed: Nov. 30, 2017

(65) Prior Publication Data

US 2019/0162030 A1 May 30, 2019

(51) Int. Cl.

| | |
|---|---|
| ***E21B 15/00*** | (2006.01) |
| ***E21B 15/02*** | (2006.01) |
| ***E21B 41/00*** | (2006.01) |
| ***E21B 17/01*** | (2006.01) |

(52) U.S. Cl.

CPC ..... *E21B 15/003* (2013.01); *E21B 15/02* (2013.01); *E21B 17/01* (2013.01); *E21B 41/00* (2013.01)

(58) Field of Classification Search

CPC ..... E21B 15/003
USPC ..... 166/379
See application file for complete search history.

(56) References Cited

U.S. PATENT DOCUMENTS

| | | | | |
|---|---|---|---|---|
| 335,164 | A | 2/1886 | Vitalis | |
| 5,954,305 | A | 9/1999 | Calabro | |
| 6,681,894 | B1 | 1/2004 | Fanguy | |
| 6,848,539 | B2 | 2/2005 | Lee et al. | |
| 8,235,126 | B2 | 8/2012 | Bradley | |
| 8,302,736 | B1 | 11/2012 | Olivier | |
| 9,080,336 | B1 | 7/2015 | Yantis | |
| 9,540,908 | B1 | 1/2017 | Olivier | |
| 2007/0193749 | A1 | 8/2007 | Folk | |
| 2009/0090513 | A1* | 4/2009 | Bissonnette | E21B 17/206 166/380 |
| 2010/0244404 | A1* | 9/2010 | Bradley | E21B 41/00 280/415.1 |
| 2011/0024231 | A1 | 2/2011 | Wurth et al. | |

(Continued)

FOREIGN PATENT DOCUMENTS

| | | |
|---|---|---|
| CA | 2629578 | 10/2009 |
| WO | WO2009129607 A1 | 10/2009 |

(Continued)

OTHER PUBLICATIONS

International Search Report and Written Opinion issued in International Application No. PCT/US2018/061198 dated Feb. 20, 2019, 14 pages.

(Continued)

*Primary Examiner* — Taras P Bemko
(74) *Attorney, Agent, or Firm* — Fish & Richardson P.C.

(57) ABSTRACT

A first platform is mounted to a central riser that is configured to flow a fluid into or out of a wellbore. The central riser is fluidically and structurally attached to a wellhead. The first platform is positioned relative to the central riser to allow access to substantially all external portions of the central riser from the first platform. A second platform is positioned above and supported by the first platform. The first platform is positioned between the second platform and the wellhead. The second platform is movable relative to the first platform.

24 Claims, 3 Drawing Sheets

(56) References Cited

U.S. PATENT DOCUMENTS

| | | | | |
|---|---|---|---|---|
| 2011/0036662 | A1 | 2/2011 | Smith | |
| 2011/0278094 | A1 | 11/2011 | Gute | |
| 2013/0213663 | A1* | 8/2013 | Lau | E21B 17/01 166/367 |
| 2015/0376907 | A1* | 12/2015 | Nguyen | E21B 33/06 182/222 |
| 2016/0332856 | A1* | 11/2016 | Steedley | B66F 11/044 |

FOREIGN PATENT DOCUMENTS

| | | | |
|---|---|---|---|
| WO | WO2011135541 | | 11/2011 |
| WO | WO2012058290 | | 5/2012 |
| WO | WO2016003662 | A1 | 1/2016 |

OTHER PUBLICATIONS

Gulf Cooperation Council Examination Report issued in GCC Application No. GC 2018-36522 dated Mar. 26, 2020, 4 pages.

* cited by examiner

MULTI-LEVEL WELLHEAD SUPPORT PLATFORM

TECHNICAL FIELD

This disclosure relates to worker support platforms, more specifically support platforms in the oil and gas industry.

BACKGROUND

Wellhead work platforms have been used for various oil and gas operations such as "snubbing" where a string of pipe is forced into a wellbore under pressure. The work platform makes it easier and safer for personnel to work at heights to perform such operations. Wellhead work platforms can be stand-alone platforms that are self-supported, or wellhead work platforms can be supported by the wellhead directly or indirectly. Wellhead work platforms can be either permanent or temporary installations.

SUMMARY

This specification describes technologies relating to wellhead support platforms.

An example implementation of the subject matter described within this disclosure is a first wellhead work platform with the following features. A first platform is mounted to a central riser that is configured to flow a fluid into or out of a wellbore. The central riser is fluidically and structurally attached to a wellhead. The first platform is positioned relative to the central riser to allow access to substantially all external portions of the central riser from the first platform. A second platform is positioned above and supported by the first platform. The first platform is positioned between the second platform and the wellhead. The second platform is movable relative to the first platform.

Aspects of the example implementation, which can be combined with the example implementation alone or in combination, include the following. The central riser includes a blowout preventer. The blowout preventer includes a flange to which the first platform is mounted.

Aspects of the example implementation, which can be combined with the example implementation alone or in combination, include the following. A ladder or staircase is connected to the first platform (or the second platform). The ladder or staircase connects the first platform and the second platform.

Aspects of the example implementation, which can be combined with the example implementation alone or in combination, include the following. The ladder or staircase is removably or collapsibly connected to the first platform (or the second platform).

Aspects of the example implementation, which can be combined with the example implementation alone or in combination, include the following. The second platform includes a hinge at a support point. The hinge is configured to allow the second platform to be collapsed.

Aspects of the example implementation, which can be combined with the example implementation alone or in combination, include the following. The hinge has a horizontal axis of rotation.

Aspects of the example implementation, which can be combined with the example implementation alone or in combination, include the following. The second platform includes telescoping supports that transfer a support load to the first platform.

Aspects of the example implementation, which can be combined with the example implementation alone or in combination, include the following. A lifting device is attached to the first or second platform. The lifting device is configured to lift tools and equipment.

Aspects of the example implementation, which can be combined with the example implementation alone or in combination, include the following. One or more mounting points are attached to either the first platform or the second platform. The mounting points configured to accept tools.

Aspects of the example implementation, which can be combined with the example implementation alone or in combination, include the following. A primary steel structure is attached to the central riser. The primary steel structure is configured to direct a load into the central riser. The primary steel structure radiates out from a central attachment point. Grating lays across at least a portion of the primary steel structure. The grating is configured to support a weight of equipment or a worker.

Aspects of the example implementation, which can be combined with the example implementation alone or in combination, include the following. The grating comprises fiberglass.

Aspects of the example implementation, which can be combined with the example implementation alone or in combination, include the following. A safety tie-off point is configured to be attached to a cable, cord, or strap that is attachable to a worker to provide fall protection to the worker.

Aspects of the example implementation, which can be combined with the example implementation alone or in combination, include the following. The first platform fully encircles the central riser.

An example implementation of the subject matter described within this disclosure is a second wellhead work platform with the following features. A first platform has a first width and a first length. The first platform is configured to support at least a weight of a wellbore worker. The first platform is mounted to a central riser connected to a wellhead of a wellbore. The first platform is positioned relative to the central riser to allow the wellbore worker access to substantially all external portions of the central riser from the first platform. A second platform has a second width and a second length less than the first width and the first length, respectively. The second platform is supported by the first platform. The second platform is configured to support at least the weight of the wellbore worker. The first platform is positioned between the second platform and the wellhead. The second platform is movable relative to the first platform.

Aspects of the example second wellhead work platform, which can be combined with the example second wellhead work platform alone or in combination, include the following. The first platform surrounds all the external portions of the central riser.

Aspects of the example second wellhead work platform, which can be combined with the example second wellhead work platform alone or in combination, include the following. The first platform is configured to support a weight of well tools including a termination tool.

Aspects of the example second wellhead work platform, which can be combined with the example second wellhead work platform alone or in combination, include the following. The second platform is configured to support the weight of the well tools.

Aspects of the example second wellhead work platform, which can be combined with the example second wellhead work platform alone or in combination, include the following. The second platform is movable along an axis transverse to the central riser.

Aspects of the example second wellhead work platform, which can be combined with the example second wellhead work platform alone or in combination, include the following. The central riser comprises a blowout preventer.

Aspects of the example second wellhead work platform, which can be combined with the example second wellhead work platform alone or in combination, include the following. The second platform fully encircles the central riser.

The details of one or more implementations of the subject matter described in this specification are set forth in the accompanying drawings and the description of this disclosure. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
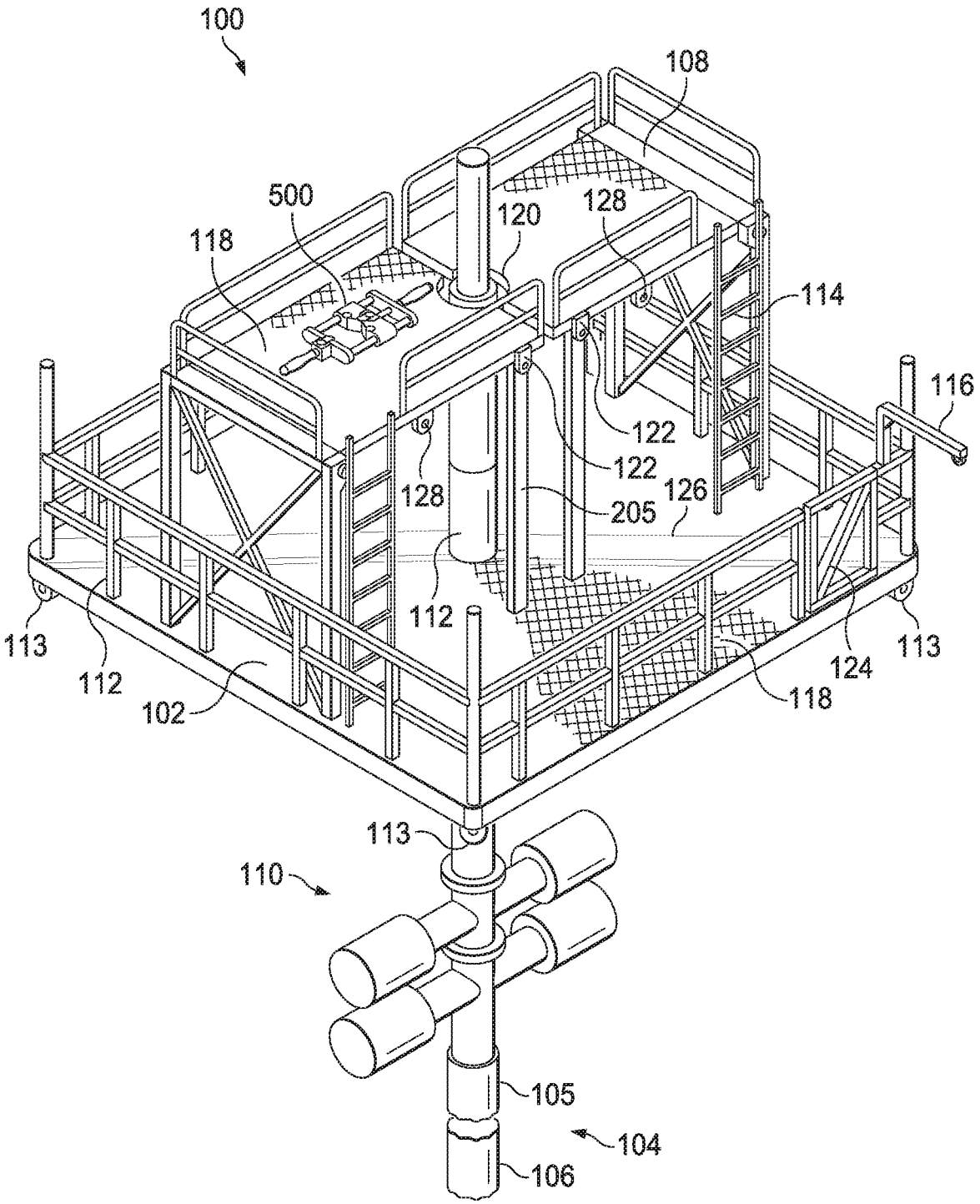
FIG. 1 is a perspective schematic diagram of an example wellhead support platform.

Certain operations, such as rig-less deployment of power cable conductors for Electric Submersible Pumps (ESPs), require working at heights to install the ESP system in the well while the wellhead remains in place. The power cable is a continuous cable deployed into the well. The cable is deployed by a Coiled Tubing (CT) unit, traction wench, or other similar tool. Prior to deployment of the ESP, a Blowout Preventer (BOP) or ram type actuator is installed on top of the wellhead or tree to provide control of the well. On offshore dry-tree platforms with several wellheads spaced closely together, portable work platforms need to be configured in such a way as to provide unobstructed work access to a desired well while not obstructing surrounding wellheads.

An ESP Bottom Hole Assembly (BHA), which includes several long assemblies, is made-up on top of the wellhead and run into the well. Electrical and mechanical connections for the BHA are made at surface before the BHA is lowered into the well. The work to make these connections takes place on top of (above) the wellhead and BOP stack.

This application discloses a temporary, multi-level, portable work platform for the make-up of equipment above the wellhead BOP. The work platform provides access for personnel to freely move about to make-up connections. For the BHA connection, a lower fixed platform is used. An upper platform (above the lower fixed platform) can be repositioned out of the way of any tools that need to be lowered to the temporary work platform. In one example, once the BHA connection is made, a CT injector head with strippers, along with the continuous cable, can be lowered to the work platform spool and made up pressure tight to the spool. The BHA can then be deployed to the desired depth.

The work platform includes a sturdy structure with a structural frame that can be attached at a flanged spool which bolts to a wellhead or BOP. In some instances, the platform can be installed just above a crown valve. The spool is pressure containing with flange seal rings on the top and bottom flanges. The platform is attached to the spool by welding, bolting, clamping, or other attachment techniques. The platform provides 360 degree personnel access on at least two elevations or levels. The elevated platform is expected to be approximately 10 feet above the primary platform to allow walking under the upper platform, but the elevation can be between 3 feet and 12 feet. The elevated platform is reached by either a ladder or stairs. The elevated platform can be repositioned out of the way to allow pressure control and coiled tubing deployment equipment, such as a coiled tubing injector head, to be connected to the upper flange of the spool to provide an integral pressure control stack. The platform includes features, such as removable handrails, ladders, grating, gate access, and davit arms for attaching retractable personal fall protection. The platform includes lift pad eyes for placing the work platform on location. In some instances, pad eyes below the platform are used to attach guy wires to increase platform stability. The wellhead working platform provides all loads through the central riser (BOP, tree, crown valve, etc.) rather than through the offshore platform deck structure which typically does not include structural members around the wellheads. The wellhead working platform can also be used on onshore wells.

FIG. 1 is an isometric view of an example wellhead work platform 100. A first, lower platform 102 is mounted to a central riser 104 that is configured to flow a fluid into or out of a wellbore. The central riser 104 is fluidically and structurally connected to a wellhead 106. In some instances, the central riser includes a BOP 110. The BOP 110 includes a flange 112 to which the first platform 102 is mounted. The flange can be a raised face flange, a flat faced flange, a ring type joint flange, or any other flange with sufficient strength to support the wellhead work platform 100. In some instances, the BOP 110 is installed atop a well tree 105. The first platform 102 is positioned relative to the central riser 104 to allow access to substantially all external portions of the central riser 104 from the first platform. In other words, the first platform 102 completely surrounds the central riser 104 in the illustrated example. That is, the first platform 102 fully encircles the central riser 104. In the illustrated implementation, the first platform 102 has a rectangular shape with a width and a length. In some instances, the first platform 102 can have a circular shape, an octagonal shape, or any other shape that allows full access to the central riser 104. The first platform 102 is configured to support at least a weight of a wellbore worker, a weight of one or more pieces of equipment, or combinations of them. In some instances, a wellbore worker can weigh over three hundred fifty pounds. In some instances, equipment can weigh substantially five hundred pounds The first platform 102 includes handrails 112 that can be installed on-site. In some instances, an access gate 124 can also be included. In some instances, the first platform 102 also include grating 118 that is configured to transfer and distribute a load to primary steel 126 of the first platform 102. Details on the grating 118 and the primary steel 126 are described later within this disclosure. In the contest of this disclosure, the primary steel 126 can be considered steel, aluminum, or a composite material of sufficient strength to carry the load of the wellhead work platform 100.

A second platform 108 is positioned above and is supported by the first platform 102. The second platform 108 is movable relative to the first platform 102. That is, the second platform 108 is movable relative to the central riser. More specifically, the second platform 108 is configured to rotate, slide, or otherwise move away from the central riser 104 to allow access for certain tools. In the illustrated example, a ladder 114 connects the first platform 102 and the second platform 108. The ladder 114 can be secured to either the first platform 102 or the second platform 108. In some instances, a staircase can be used in lieu of or in addition to the ladder 114. In some instances, such as the illustrated example, more than one ladder 114 can be used. In some instance, the ladder 114 can be moved out of the way.

As illustrated, the second platform 108 has a rectangular shape with a width and a length less than or equal to the width and the length, respectively, of the first platform 102. In some instances, the second platform 108 can have a circular shape, octagonal shape, or any other shape that allows full access to the central riser 104. In some instances, the upper platform can fully encircle the central riser 104. In some instances, the upper platform 108 can allow partial access to the central riser 104. In some instances, the second, upper platform 108 can include an opening 120 to allow a wellbore tool to pass through the platform, such as an ESP BHA, a long coiled tubing or wireline BHA strings, such as logging or MWD tools, which may require access at multiple locations. The upper platform 108 can be used in place of a working window in which the height is determined by length of access required. The upper platform 108 can increase efficiency in BHA makeup by allowing work to be performed at two or more elevations without having to deploy or move the BHA. In some instances, the second platform 108 can have a greater width, length, or both than the first platform 102, so long as the first platform 102 is capable of supporting the second platform 108. In some instances, the second platform 108 can have a greater usable work surface than the first platform 102. The second platform 108 is supported by the first platform 102. In some instances, a collapsible structure can be mounted to the second platform 108 at a structural mounting point 122. More details on such an implementation are described later within this disclosure. The second platform 108 is configured to support at least the weight of a single wellbore worker, a weight of one or more pieces of equipment, or combinations of them. In some instances, a wellbore worker can weigh over three hundred fifty pounds. In some instances, equipment can weigh substantially five hundred pounds. The first platform 102 is positioned between the second platform 108 and the wellhead 106. The second platform 108 is movable relative to the first platform 102.

The wellhead work platform 100 includes a lifting device 116 attached to either to the first platform 102 or the second platform 108. The lifting device 116 is configured to lift tools and equipment and can include an air winch, a davit crane, or any other suitable lifting device. The lifting device 116 can be pneumatically, hydraulically, or electrically powered. The wellhead work platform 100 includes one or more mounting points 128 attached to either the first platform 102 or the second platform 108. The mounting points are configured to accept tools for workers to use on the wellhead work platform 100. In some instances, the wellhead work platform is configured to support a weight of any well tools needed by a well worker, for example a termination tool 500. Both the first platform 102 and the second platform 108 are configured to support the weight of any necessary well tools. The wellhead work platform 100 also includes one or more safety tie-off points 128 configured to be attached to a cable, cord, or strap that is attachable to a worker to provide fall protection to the worker.

The wellhead work platform 100 includes lifting points 113 that can be used to lift, maneuver, install, uninstall, and otherwise move the work platform 100. The lifting points are configured to bear at least a portion of the weight of the wellhead work platform as applicable to any codes and standards to which the wellhead work platform is built. The lifting points 113 are secured to the primary steel 126.

The first platform 102 of the wellhead work platform 100 includes a primary steel 126 that connects to the central riser. The primary steel 126 is configured to direct a load from the wellhead work platform 100 into the central riser. In some instances, the primary steel 126 can be built to specified standards and codes, for example, ISO 14122128. In such an instance, the code or standard can dictate the type of primary steel 126 used. For example, the primary steel 126 can be designed and built to radially extend outward from a central attachment point. In some instances, a primary steel truss structure can be used. To save weight, grating 118 lays across at least a portion of the primary steel structure. The grating 118 is configured to support a weight of one or more pieces of equipment, one or more workers, or combinations of them. In some instances, a wellbore worker can weigh over three hundred fifty pounds. In some instances, equipment can weigh substantially five hundred pounds. The grating is configured to meet the requirements of any specified standards or codes. In some instances, the grating 118 is secured to the primary steel 126 by a bolt or other fastening mechanism. In some instances, the grating 118 can include fiberglass or other composite material. The second, upper platform 108 includes grating 118 as well. The primary steel structure can be assembled by welding, bolting, or any other connecting mechanism that is allowed by the applicable standards or codes. In some instances, the wellbore work platform 100 can be assembled on-site to reduce the size of a shipping container. In some instances, the wellbore work platform 100 can be shipped completely or partially assembled to reduce labor time on assembly.

Figure 2:
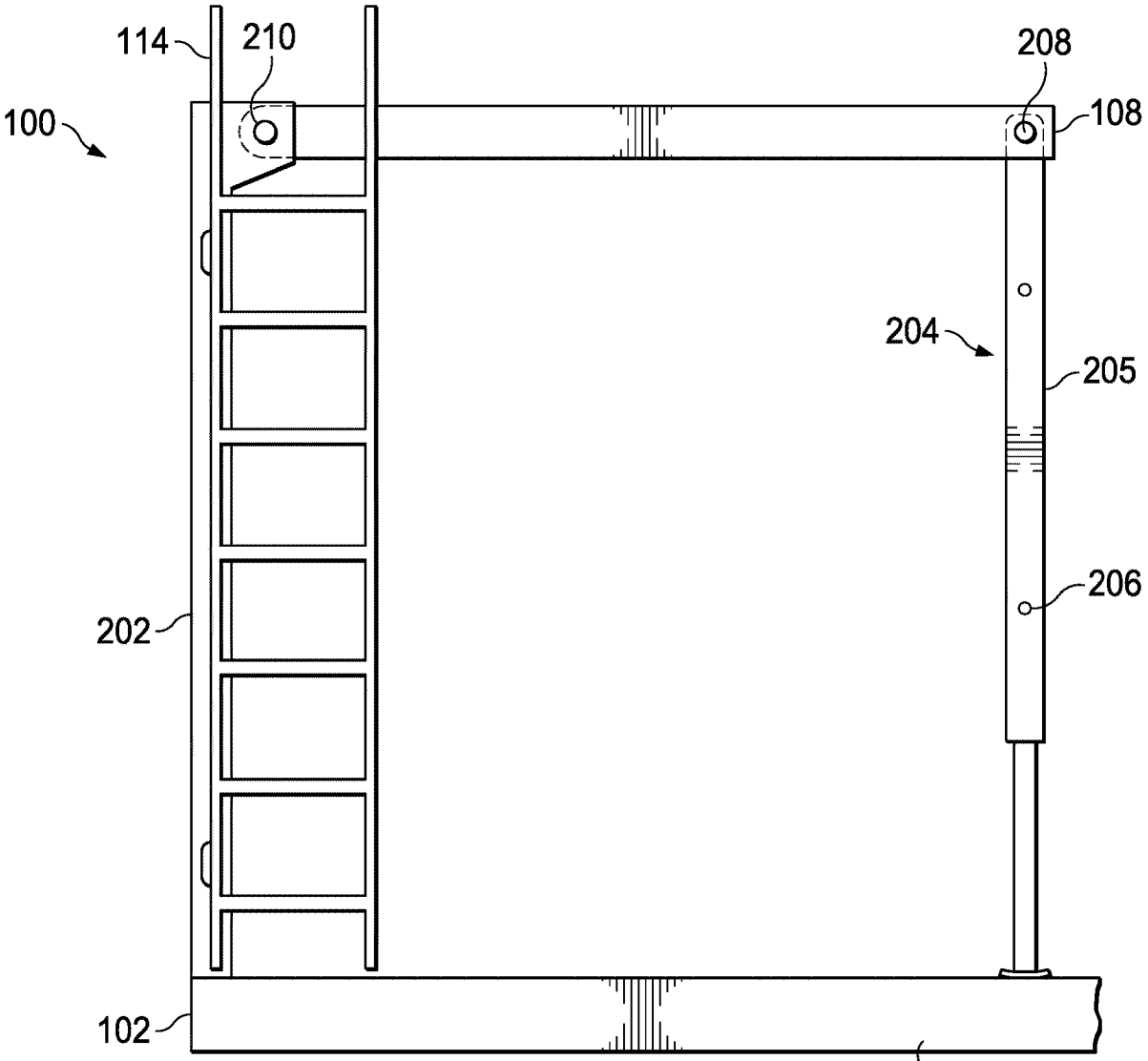
FIG. 2 is a side view of an example deployed upper platform.

FIG. 2 is a detailed side view of an example deployed second platform 108. As previously described, the second, upper platform 108 is supported by the first, lower platform 102. The second platform 108 can connect to the first platform 102 with a permanent steel support 202, a collapsible structure 204, or both. In this example, the collapsible structure 204 includes a foldable, telescoping leg 205. The leg 205, in its extended position, is held in place by a retention pin 206. The collapsible structure 204 is secured to the second platform 108 with a hinge 208. While in an extended position, the collapsible structure 204 transfers the load of the second platform 108 to the first platform 102. The collapsible structure 204 is configured to impart the load into primary steel 126 carried within the first platform 102 per any standards or codes with which the platform 100 is designed and built. Further design and construction details are described later in this disclosure.

In the illustrated implementation, the second platform 108 is collapsible along an axis transverse to a central axis of the central riser 104 with a second hinge 210. That is, the hinge 210 has a horizontal axis of rotation. Details on the exact mechanics of operation for the second platform 108 are described later within this disclosure. While the illustrated example shows a horizontal hinge 210 being used to collapse the second platform 108, a vertically oriented hinge could also be used to swing the platform out of the way. In some instances, the ladder 114 (or staircase) is removably or collapsibly connected to the first platform 102 or the second platform 108. In such an instance, the ladder 114 can be removed before or after the second platform 108 is moved to the collapsed position.

Figure 3B:
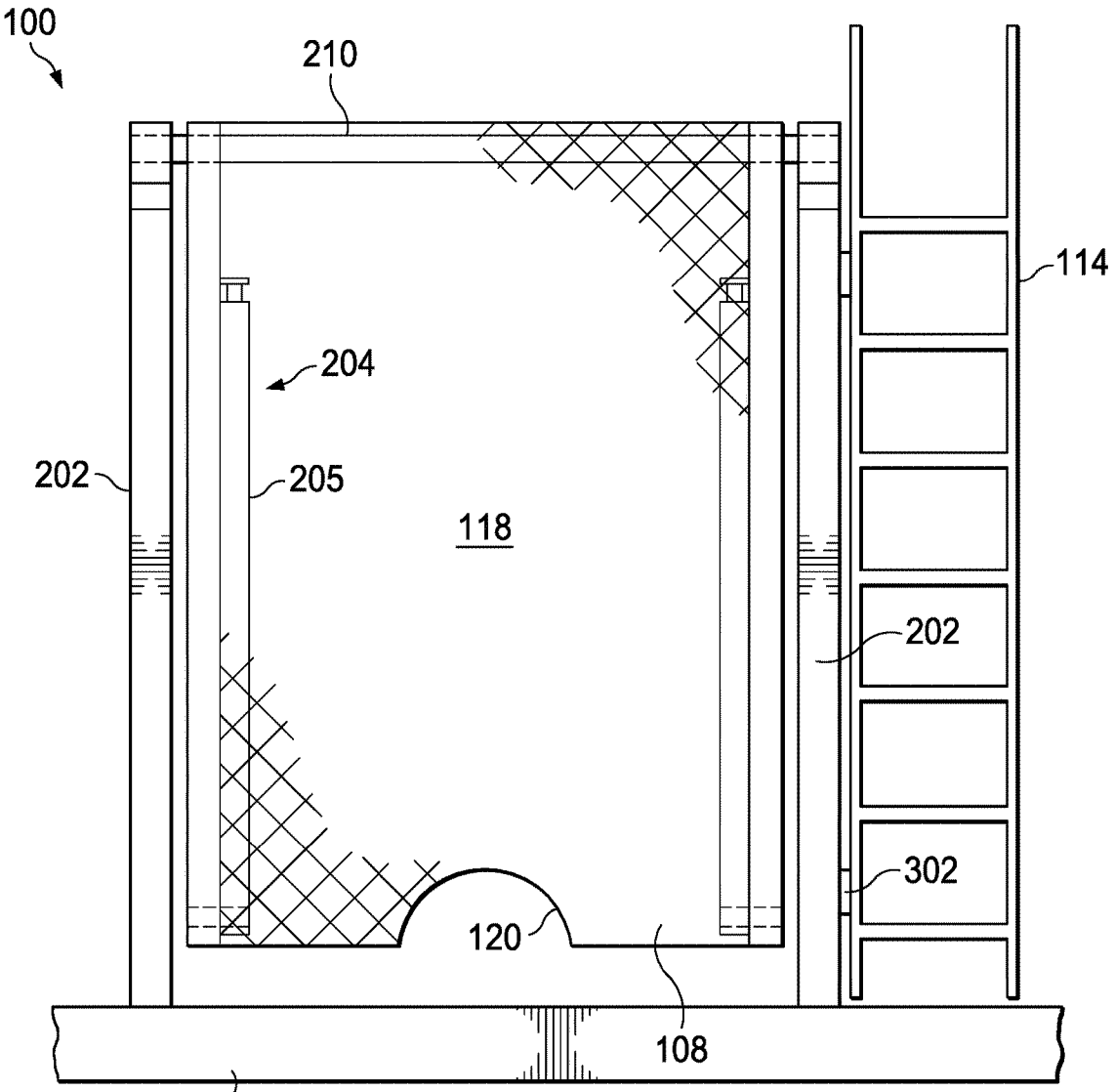
FIGS. 3A-3B are side and front views of an example upper platform in a retracted state.
Figure 3A:
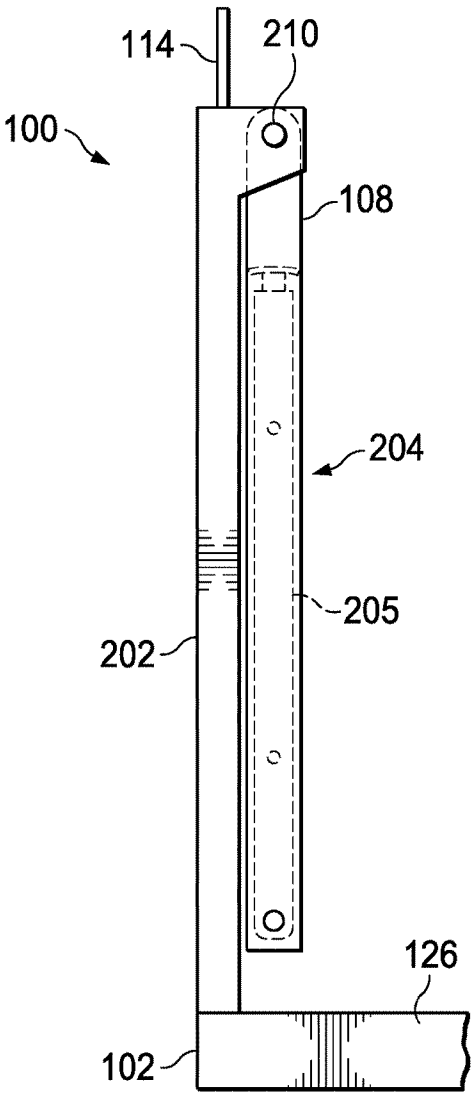

FIGS. 3A-3B show a side and front view of the second platform 108 in a collapsed position. In the illustrated implementation, the collapsible structure 204 has been retracted and folded into the second, upper platform 108. The platform 108 has folded towards the first, lower platform 102 around the hinge 210. The folded second platform 108 is supported by the support structure 202 and the hinge 210 in the illustrated implementation. In some instances, the ladder 114 is attached to the support structure 202 by a ladder hinge 302. The ladder 114 rotates around the ladder hinge 302 to be moved out of the way when not needed. In some instances, the ladder can be removed completely. In some instances, a removable, collapsible, or rotatable staircase can be used in lieu of the ladder 114.

The following is an example scenario in which the wellhead work platform 100 can be utilized. Once at depth, a CT injector head is unbolted from a spool and raised to provide access to the cable for cable termination. Termination of the cable at surface is approximately 10 feet above the lower platform 102 to allow for makeup of the upper connection. At a height of ten feet above the lower platform, termination of the cable and makeup of the connection is not practical from the lower platform 102. To access the higher elevation, the second, upper platform 108 is raised into position. A movable support leg 205 (collapsible structure 204) is placed to keep the upper platform 108 in position and to provide load carrying capability. The ladder 114 (or stairs) may either be already in place or moved into place to allow access to the upper platform 108.

While this specification contains many specific implementation details, these should not be construed as limitations on the scope what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features previously described as acting in certain combinations and even initially claimed as such, one or more features from a claimed combination can in some cases be excised from the combination, and the claimed combination may be directed to a subcombination or variation of a subcombination.

Similarly, the separation of various system components in the implementations previously described should not be understood as requiring such separation in all implementations, and it should be understood that the described components and systems can generally be integrated together in a single product or packaged into multiple products.

Thus, particular implementations of the subject matter have been described. Other implementations are within the scope of the following claims.

What is claimed is:

1. A wellhead work platform comprising:

a first platform mounted to a central riser configured to flow a fluid into or out of a wellbore, the central riser fluidically and structurally attached to a wellhead, the first platform positioned relative to the central riser to allow access to substantially all external portions of the central riser from the first platform;

a second platform positioned above and supported by the first platform, the first platform positioned between the second platform and the wellhead, the second platform being movable relative to the first platform, the second platform configured to be transverse to the central riser in one configuration and to be folded towards the first platform in another configuration; and a collapsible structure secured to the second platform, the collapsible structure configured to extend between the first platform and the second platform to support the second platform when the second platform is transverse to the central riser and to be folded into the second platform when the second platform is folded towards the first platform.

2. The wellhead work platform of claim 1, wherein the central riser comprises a blowout preventer, wherein the blowout preventer comprises a flange to which the first platform is mounted.

3. The wellhead work platform of claim 1, further comprising a ladder or staircase connected to the first platform or the second platform, the ladder or staircase connecting the first platform and the second platform.

4. The wellhead work platform of claim 1, wherein the second platform comprises a hinge at a support point, wherein the hinge is configured to allow the second platform to be collapsed.

5. The wellhead work platform of claim 4, wherein the hinge has a horizontal axis of rotation.

6. The wellhead work platform of claim 1, wherein the second platform comprises telescoping supports configured to transfer a support load to the first platform.

7. The wellhead work platform of claim 1, further comprising a lifting device attached to the first or second platform, the lifting device configured to lift tools and equipment.

8. The wellhead work platform of claim 1, further comprising one or more mounting points attached to either the first platform or the second platform, the mounting points configured to accept tools.

9. The wellhead work platform of claim 1, wherein the first platform comprises:

a primary steel structure attached to the central riser, the primary steel structure configured to direct a load into the central riser, the primary steel structure radiating out from a central attachment point; and grating that lays across at least a portion of the primary steel structure, the grating configured to support a weight of equipment or a worker.

10. The wellhead work platform of claim 9, wherein the grating comprises fiberglass.

11. The wellhead work platform of claim 1, further comprising a safety tie-off point configured to be attached to a cable, cord, or strap that is attachable to a worker to provide fall protection to the worker.

12. The wellhead work platform of claim 1, wherein the first platform fully encircles the central riser.

13. The wellhead work platform of claim 1, wherein the collapsible structure comprises a telescoping leg configured to extend to the first platform to transfer the load of the second platform to the first platform.

14. A wellhead work platform comprising:

a first platform mounted to a central riser configured to flow a fluid into or out of a wellbore, the central riser fluidically and structurally attached to a wellhead, the first platform positioned relative to the central riser to allow access to substantially all external portions of the central riser from the first platform;

a second platform positioned above and supported by the first platform, the first platform positioned between the second platform and the wellhead, the second platform being movable relative to the first platform, the second platform configured to be transverse to the central riser in one configuration and to be folded towards the first platform in another configuration; and a collapsible structure secured to the second platform, the collapsible structure configured to extend between the first platform and the second platform to support the second platform when the second platform is transverse to the central riser and to be folded into the second platform when the second platform is folded towards the first platform; and a ladder or staircase extending between the first platform and the second platform when in an extended position.

15. The wellhead work platform of claim 14, wherein the collapsible structure comprises a telescoping leg configured to extend to the first platform to transfer the load of the second platform to the first platform.

16. A wellhead work platform comprising:

a first platform having a first width and a first length, the first platform configured to support at least a weight of a wellbore worker, the first platform mounted to and primarily supported by a central riser connected to a wellhead of a wellbore, the first platform positioned relative to the central riser to allow the wellbore worker access to substantially all external portions of the central riser from the first platform;

a second platform having a second width and a second length less than the first width and the first length, respectively, the second platform supported by the first platform, the second platform configured to support at least the weight of the wellbore worker, the first platform positioned between the second platform and the wellhead, the second platform being movable relative to the first platform, the second platform configured to be transverse to the central riser in one configuration and to be folded towards the first platform in another configuration; and a collapsible structure secured to the second platform, the collapsible structure configured to extend between the first platform and the second platform to support the second platform when the second platform is transverse to the central riser and to be folded into the second platform when the second platform is folded towards the first platform.

17. The wellhead work platform of claim 16, wherein the first platform surrounds all the external portions of the central riser.

18. The wellhead work platform of claim 16, wherein the first platform is further configured to support a weight of well tools comprising a termination tool.

19. The wellhead work platform of claim 18, wherein the second platform is configured to support the weight of the well tools.

20. The wellhead work platform of claim 16, wherein the second platform is rotatable along an axis transverse to the central riser.

21. The wellhead work platform of claim 16, wherein the central riser comprises a blowout preventer.

22. The wellhead work platform of claim 16, wherein the second platform fully encircles the central riser.

23. The wellhead work platform of claim 16, further comprising a ladder or staircase extending between the first platform and the second platform when in an extended position.

24. The wellhead work platform of claim 16, wherein the collapsible structure comprises a telescoping leg configured to extend to the first platform to transfer the load of the second platform to the first platform.

* * * * *